United States Patent [19]

Shannon et al.

[11] Patent Number: 4,514,435

[45] Date of Patent: Apr. 30, 1985

[54] METHOD FOR PRODUCTION OF DIELECTRIC INSULATION LAYERS UPON ELECTRICAL CONDUCTORS

[75] Inventors: Michael A. Shannon, Glenburnie; Robert J. Howat, Kingston, both of Canada

[73] Assignee: Northern Telecom Limited, Montreal, Canada

[21] Appl. No.: 597,393

[22] Filed: Apr. 6, 1984

[51] Int. Cl.[3] ..... B05D 1/04

[52] U.S. Cl. ..... 427/8; 427/47; 427/117; 427/128

[58] Field of Search ..... 427/8, 47, 117, 128

*Primary Examiner*—Bernard D. Pianalto

*Attorney, Agent, or Firm*—R. J. Austin

[57] ABSTRACT

Monitoring of the quantity of magnetically permeable particles in a dry dielectric carrier layer surrounding a conductor by passing the conductor with its surrounding layer through a magnetic field created by a magnet to cause magnetic attraction between the particles and the magnet. The degree of this attraction is dependent partly upon the quantity of particles lying in the field and the degree of movement towards each other of the conductor and magnet is monitored while resisting this movement, to give an indication of the particle quantity. A method of controlling the quantity of particles is also described and which uses the monitored movement to produce signals by which the input of particles or carrier into a fluid mixture is adjusted.

7 Claims, 6 Drawing Figures

10
28
26
30
10

10
12
18
16
20
22
14

80
34
28
78
26
30
III
24
32
76
10
74
70
46
10
48
50
40
36
42
40
84
38
82
44
42

METHOD FOR PRODUCTION OF DIELECTRIC INSULATION LAYERS UPON ELECTRICAL CONDUCTORS

This invention relates to the production of dielectric insulation layers upon electrical conductors.

In the telecommunications cable industry, it is common practice to surround each electrical conductor with at least one layer of dielectric material which affects the electrical performance of the conductor, e.g. by producing a desired dielectric effect and helping to provide other design characteristics such as mutual capacitance between conductors. Inductive effect is also an important consideration and, for various reasons, continuous inductive loadings have been proposed and used in dielectric layers of electrical conductors in the telecommunications industry. These continuous inductive loadings have comprised discrete particles of magnetically permeable material, such as ferrite, which are dispersed throughout a dielectric carrier material such as a polymeric substance, e.g. polyethylene or polyvinylchloride. Dielectric layers containing particles of magnetically permeable material will be referred to in this specification as "continuous loaded layers". There are at least two problems which need to be overcome if electrical conductors having such continuous loaded layers are to produce consistently the electrical characteristics for which they are designed. One of these problems is the production of homogeneity in the mix, which is produced with the carrier material in a fluid state. Another problem concerns the control of the relative volumetric or weight quantities of the carrier material and the particles within the mix.

This invention is concerned with the monitoring of the quantity of particles in a dried layer of dielectric carrier material surrounding a conductor in order to determine whether homogeneity in the mix and control of the relative quantities of the carrier material and the particles has been achieved.

Accordingly, the present invention provides a method of monitoring a quantity of magnetically permeable particles in a dry dielectric carrier layer surrounding a conductor comprising passing the conductor surrounded by the layer along a feedpath and through a magnetic field created by a magnet means to cause a magnetic attraction between the particles and the magnet means, the degree of which is dependent upon the strength of the magnetic field and the quantity of particles in the layer which are affected by the field, and monitoring the degree of relative movement towards each other of the conductor and magnet means as the conductor moves along its path.

The degree of relative movement may be provided by allowing the conductor to move laterally of its path towards the magnet means. In this case the resisting force to such movement would be provided by the tensile stresses in the conductor.

Allowing for such lateral movement of the conductor may raise practical problems and the method preferably allows for the movement of the magnet means towards the conductor, which is restrained from moving towards the magnet means. In this case the degree of movement of the magnet means is monitored.

In a preferred method, the conductor is moved along the feedpath which extends towards and away from the magnet means and through the field at a plurality of positions along the feedpath to cause a degree of movement of the magnet means relative to the conductor and which is dependent upon the quantity of particles affected by the field in these positions. This preferred method enables the average amount of magnetically permeable particles on a longer length of conductor to be monitored. Thus, any change in the degree of movement of the magnet means indicates a change in the average quantity of the particles along this length and shows any prolonged tendency for the particles to increase or decrease per unit length of conductor.

The method of monitoring according to the invention may be used conveniently in a method of controlling within predetermined limits the quantity of particles per unit length of conductor in a dry carrier layer. In this particular process the conductor is coated with the layer in controlled thickness and in fluid form from a mixture of fluid carrier material and the particles. The layer is then dried and the conductor is passed continuously along its feedpath while the quantity of magnetically permeable particles in the layer is monitored. Monitoring produces a signal corresponding to the degree of relative movement of the conductor and the magnet means. This signal is then compared with a datum signal corresponding to a desired quantity of particles per unit length of conductor and, dependent upon any variation between the provided and datum signals, the input of ingredients into the mixture is adjusted so as to correspondingly adjust the quantity of particles per unit length of the conductor towards that which is desired.

The invention also includes an apparatus for monitoring the quantity of magnetically permeable particles in a dry dielectric carrier layer surrounding a conductor comprising means to pass the conductor carrying the layer along a feedpath; magnet means disposed at one side of at least one part of the feedpath to create a magnetic field extending across said one part of the feedpath; means to allow for relative movement towards and away from each other of the magnet means and the conductor along said part of the feedpath, said movement caused by the magnetic attraction between the particles and the magnet means; and monitoring means to monitor the degree of said movement.

The invention further comprises an apparatus for controlling between predetermined limits, the quantity of magnetically permeable particles per unit length of conductor in a dry dielectric carrier layer surrounding the conductor comprising coating means for forming the layer in a controlled thickness and in fluid form from a mixture of fluid carrier material and magnetically permeable particles; means for drying the layer; apparatus for monitoring the quantity of magnetically permeable particles according to the invention above, the monitoring means comprising signal producing means to produce a signal corresponding to the degree of relative movement of the conductor and magnet means; and control means operable upon the produced signal varying from a datum signal to adjust the input of ingredients into the mixture, so as to correspondingly adjust the quantity of particles per unit length of the conductor towards that desired.

Embodiments of the invention will now be described, by way of example, with reference to the accompanying drawings, in which:

DETAILED DESCRIPTION OF THE DRAWINGS

Figures 1, 2, 3:
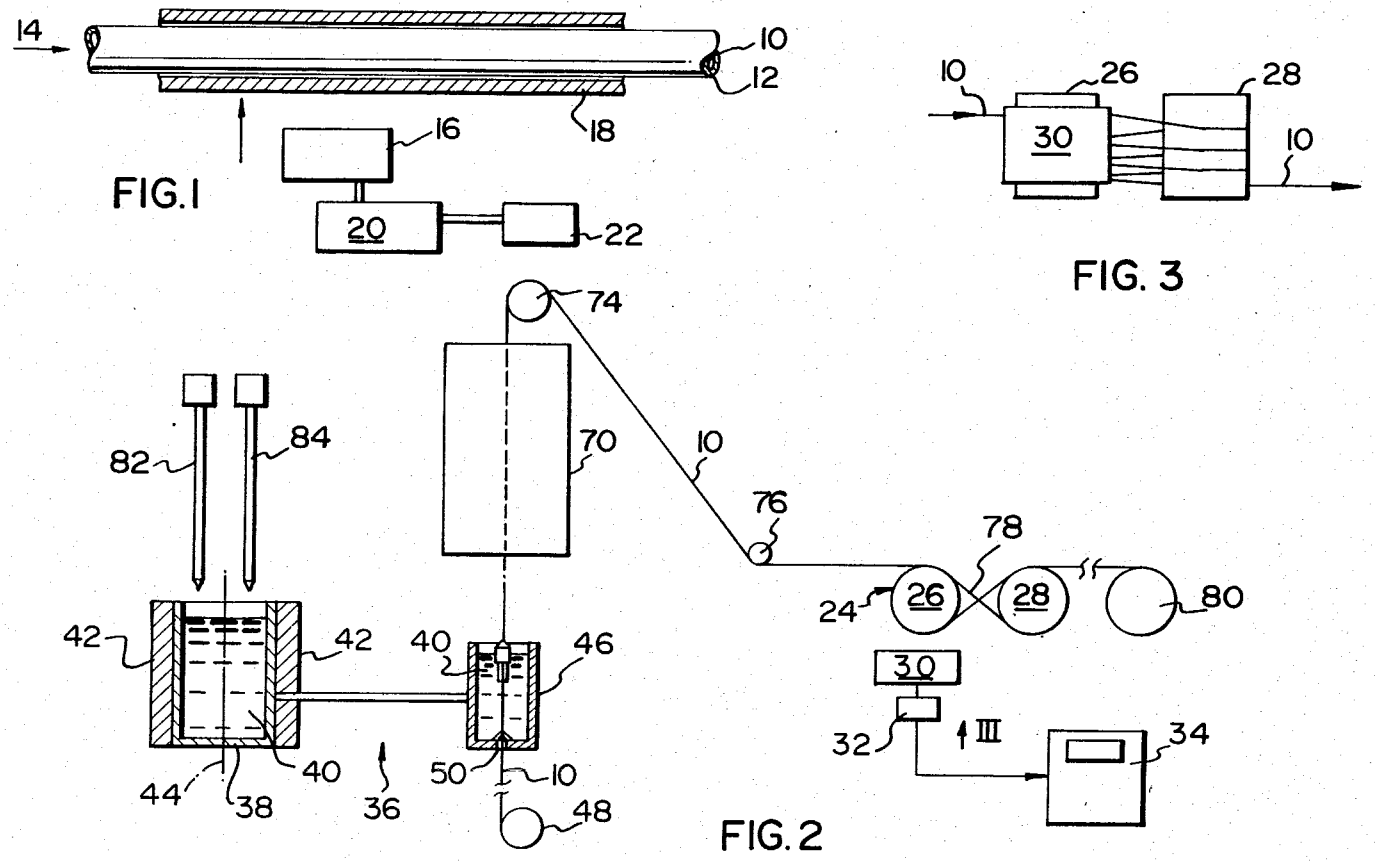
FIG. 1 is a diagrammatic view, partly in section, of apparatus according to a first embodiment for monitoring the quantity of magnetically permeable particles in a dielectric carrier layer surrounding a conductor.
FIG. 2 is a diagrammatic side elevational view of an apparatus according to a second embodiment for controlling the quantity of particles in a dry carrier layer surrounding a conductor.
FIG. 3 is a view of part of the apparatus of FIG. 2, in the direction of arrow III in FIG. 2.

As shown in FIG. 1, an apparatus according to a first embodiment is provided for monitoring the quantity of magnetically permeable particles in a dry dielectric carrier layer surrounding a conductor. The conductor 10 is a telecommunications conductor for incorporation into a cable and is insulated with a first layer 12 comprising a dry carrier material which may, for instance, be a latex emulsion or a polymeric material, e.g. polyethylene or polyvinylchloride. Embedded within the carrier are a plurality of magnetically permeable particles, which in this case are ferrite particles to form the layer into a continuous loaded layer, e.g. the layer thus provides a continuous loading along the conductor for the purpose of increasing the inductance and decreasing the attenuation of pairs of conductors in the finished cable over a band of frequencies.

The layer of material 12 may be provided upon the conductor by any convenient and practical means such as is described in further embodiments of the invention. It is important to be able to determine whether the quantity of magnetically permeable particles changes per unit length of the conductor, because it is required that, in the finished cable, the quantity of particles per unit length along the conductor is substantially constant to ensure that there is no variation in quantity which could cause a variation in the inductance and the mutual capacitance between the conductors.

For the purpose of monitoring the quantity of particles in the layer 12 as the conductor is fed along its path 14, the apparatus comprises a magnet means disposed at one side of part of the path 14. This magnet means may be an electromagnetic or a permanent magnet 16 10 according to this embodiment, and the magnet is disposed alongside a non-magnetically permeable guide tube 18 through which the conductor is fed and which forms a restraining means to prevent movement of the conductor towards the magnet means. The magnet means is itself movable towards the feedpath and has a means to resist said movement in the form of the resistance offered by a force transducer 20 to which the magnet is connected. The force transducer is electrically connected to a visual display unit which may give an indication, either on the degree of movement on the magnet or upon the degree of movement translated directly into the quantity of particles per unit length of conductor.

In operation of the apparatus according to the first embodiment, the conductor already provided with the dry dielectric layer 12 bearing the particles, is fed through the guide passage of the tube 18 along its feedpath 14. The conductor thus passes through the magnetic field created by the permanent magnet and the particles are magnetically attracted towards the magnet. However, as the conductor itself cannot move laterally from its path 14, then the magnet 16 must itself move under the resistance offered by the force transducer. The degree of movement of the magnet is dependent upon the strength of the field and also upon the quantity of particles in the layer which are affected by the field. Thus, as the magnetic field remains constant, then any variation in movement in the magnet as the conductor passes along its path indicates a change in the quantity of particles affected by the field, i.e. per unit length of the conductor. Hence, an initial movement of the magnet produces an electrical signal in the transducer which operates the display 22 to give an indication either on the degree of movement or upon the quantity of particles per unit length of conductor. Should this position of the magnet then change in either direction, then the strength of the signal from the transducer to the display unit will change thereby altering the reading in the display unit. Thus, an operator of the apparatus is informed whether the quantity of particles per unit length of the conductor remains constant or varies along the length of the conductor. The field strength in this embodiment is suitably around 1000 gauss, but is determined, as in all other embodiments, to provide effective operation dependent upon the material and magnetic permeability of the particles and also without having sufficient strength to effect any magnetic bipolar orientation of the particles.

In FIG. 2, there is shown an apparatus for controlling between predetermined limits, the quantity of magnetically permeable particles per unit length of conductor in a dry carrier layer surrounding the conductor. The apparatus of the second embodiment comprises an apparatus 24 for monitoring the quantity of particles in the dry carrier layer so as to enable the control in the quantity to be effected.

The monitoring apparatus 24 comprises two axially parallel and spaced apart cylinders 26 and 28, which provide a restraining means for preventing conductor from moving towards a magnet means in the form of a permanent magnet 30, which is disposed radially outwards from a sector of one of the cylinders, namely cylinder 26. As in the first embodiment, the magnet 30 is connected to a transducer 32 which provides signals corresponding to the movement of the magnet to a remote display unit 34 to provide the operator with information concerning magnet movement.

Figure 4:
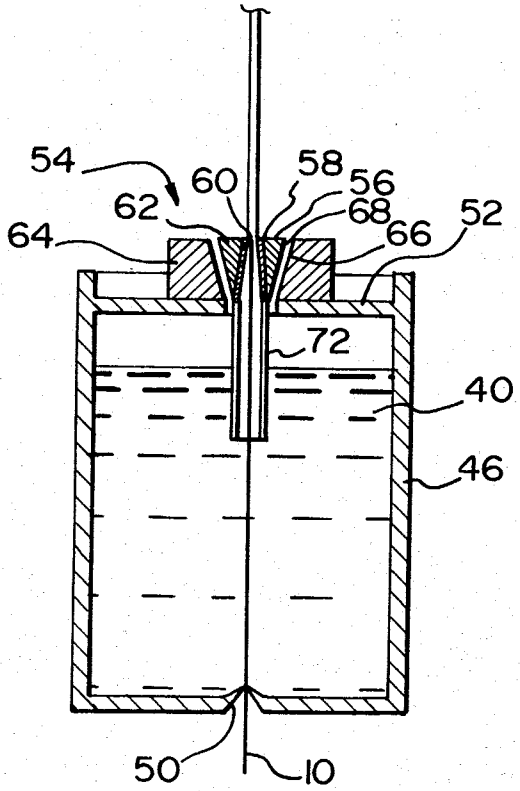
FIG. 4 is a side elevational cross-sectional view of an application container for applying a mixture of carrier and particles to the conductor and forming part of the apparatus of the second embodiment.

Upstream from the monitoring apparatus 24 is disposed an apparatus for providing the conductor 10 with the dry carrier layer 12 incorporating the ferrite particles. This apparatus 36 comprises a cylindrical mixing container 38 for providing a homogeneous mixture 40 of the carrier in a fluid condition and the magnetically permeable particles. The mixture is preferably maintained in a homogeneous condition and the homogeneity may be achieved according to the method and apparatus described in a copending patent application entitled "Maintaining Homogeneity in a Mixture", (Ref. CL-434), in the names of J. H. Walling, M. A. Shannon and G. Arbuthnot and filed concurrently with this application. In the aforementioned specification, the homogeneity is achieved within the mixing container by subjecting the mixture to a magnetic field which is rotating around the container and which at any instant is centred about an axis lying outside the container and extending in a circumferential sense of the container, so as to be inclined relative to the axis of the container. This is achieved in this embodiment by the use of three coils 42, two of which are shown in section, the coils circumferentially extending around the container and lie side-by-side in the circumferential sense. Each coil has its axis inclined to the axis 44 of the container in the manner described in the aforementioned specification. The apparatus 36 also includes an application container 46 to which the mixture 40 is fed for applying it to the conductor 10 as it is fed upwardly from a give-up spool or reel 48 and through a sealed orifice 50 in the base of the container 46. The structure of the container 46 and associated die means is as described in an application entitled "Production of Insulated Electrical Conductors" (Ref. CL-433) filed concurrently with this application in the names of J. H. Walling, M. A. Shannon and G. Arbuthnot. As described in that application and as shown in FIG. 4 of the present application, the container 46 is surmounted by a support 52 which carries the die means 54. The die means 54 comprises an inverted frustoconical die member 56 comprising a central die member 58 formed with an orifice 60. The member 58 is surrounded by an annular magnet 62 having radially spaced poles. A die holder 64 is in the form of an annular magnet also having radially spaced poles. An inner frustoconical surface 66 of the holder 64 is complementary in shape to the frustoconical surface 68 of the die means. The relationship of the poles is such that the poles at the surfaces 66 and 68 are mutually repelling poles, i.e. both poles are either south poles or north poles.

Disposed above the reservoir 46 is a means for drying the layer of material which is being applied to the conductor 10 by the die means. This drying means comprises a vertical drying oven 70 (FIG. 2).

In use of the apparatus, the mixture of materials is maintained in a homogeneous state as described in the aforementioned patent application entitled "Maintaining Homogeneity in a Mixture". The homogeneous mixture is fed to the applicator reservoir 46 and the conductor 10 is passed from the give-up 48 through the sealed orifice 50 and thence through the fluid mixture in the reservoir and the die means.

As the conductor passes through the die means, the die means 54 is held in a levitated position by the magnetic flux created between the two magnets whereby the surfaces 66 and 68 are out of contact. The conductor passes upwardly through the fluid and out through the die aperture 60 at which the layer of fluid material is wiped on to the conductor as described in the aforementioned specification entitled "Production of Insulated Electrical Conductors". As the fluid mixture passes upwardly through a downward extension 72 of the die means and through the orifice 60, the magnetic flux which is created tends to orientate the particles in a radial direction of the layer. As a specific orientation is provided, then this gives uniformity to the structure after drying in the oven 70, thus enhancing constancy in electrical characteristics.

From the drying oven 70 the conductor passes around guide rollers 74 and 76 as it approaches the monitoring apparatus 24. The conductor moves into the apparatus 24 and passes around the two cylinders 26 and 28 in opposite directions so as to provide a passover point 78 of the conductors from one cylinder to another. The two cylinders thereby act as a capstan means to assist in drawing the conductor through the apparatus. Guide means (not shown) are provided for maintaining the passes of conductor out of contact with each other as they extend from one cylinder to another. Finally the conductor is wound onto a take-up reel 80.

As the conductor is passed in successive wrappings around the cylinder 26, it is maintained along its path in contact with the cylinder 26 by the tension on the conductor. The magnet means 30 moves towards and away from the cylinder 26 dependent upon the amount of particles of magnetically permeable material in the lengths of conductor which are passing around the cylinder 26 in the parts of all the windings which lie closest to the magnet means and which therefore lie within the magnetic field created. As shown by FIG. 3 the magnet means extends for the full distance down the cylinder 26, along which the windings of the conductor extend. Hence, the attraction between the magnet means and the conductor is governed by the amounts of particles in the layer 12 at spaced positions along the conductor as determined by the distance required to wrap the conductor for one complete passage around the cylinders 26 and 28. Using this technique of providing control for the position of the magnet means, it is ensured that a rapid movement of the magnet means does not occur should there be a sudden and short variation in the amount of particles in the layer 12. Instead, because of this method of measurement, the magnet means will tend to move more slowly from one position to another upon change in amounts of particles in the conductor insulation layer as this change is fed progressively from one winding of the cylinder 26 to another. Because of this, the magnet means 30 will thus show any prolonged tendency for an increase or decrease in the quantity of particles in the insulation layer, thereby indicating that a standing problem exists in the mixture being applied to the conductor. As with the first embodiment, movement of the magnet means is recorded upon the visual display 34 for operator response. Should the operator determine that there is a prolonged change in the amount of particles in a layer from that required, then he may manually adjust the quantities of one or both of the materials into the mixing bath 38 by altering the amounts issued to the tank through inlets 82 and 84 for the individual constituent parts. These inlets are shown diagrammatically in the left hand side of the Figure.

Figure 5:
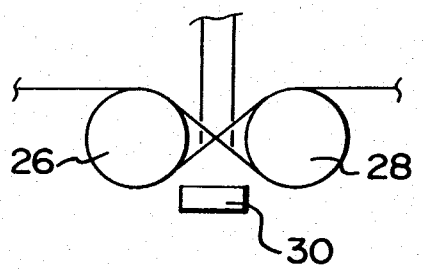
FIG. 5 is a view similar to part of FIG. 2 and showing a modification of the second embodiment.

In a modification of the second embodiment shown by FIG. 5, the magnet means is not disposed so as to face directly at a part of the surface of one of the cylinders 26 and 28, but is instead disposed so as to be controlled in its movement by the conductor parts at the cross-over points between the cylinders. As the magnet means in its movement should be affected only by the quantity of particles in the layer surrounding the conductor, then the guide means for the conductor between the cylinders should be of a non-magnetically permeable material. It would also be of assistance to ensure that the two cylinders 26 and 28 are of non-magnetically permeable material.

Figure 6:
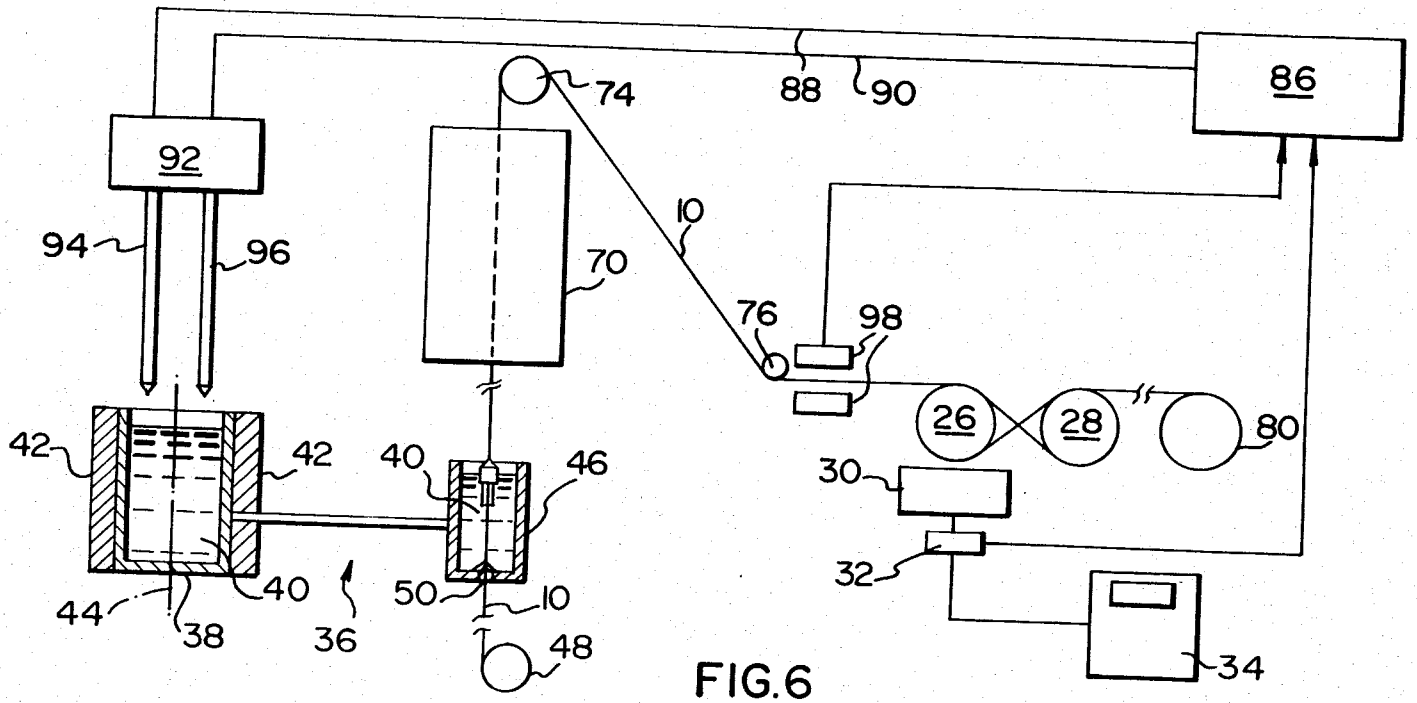
FIG. 6 is a view similar to FIG. 2 and showing a third embodiment.

In a third embodiment as shown by FIG. 6, apparatus for controlling the quantity of magnetically permeable particles per unit length of conductor is constructed basically in the manner described with regard to the second embodiment. Parts of the third embodiment which operate similarly to those in the second embodiment bear like reference numerals.

The third embodiment differs from the second embodiment basically in that it has a control means to control the quantities of the constituent parts, i.e. latex and ferrite particles, which are supplied to the mixing tank 38. The magnet means 30 operates through its transducer 32 as described in the first embodiment to produce a visual signal in the visual display 34 for operator reference. In addition, the transducer provides a signal to a microprocessor 86 of the control means. This signal is compared by the microprocessor with a datum signal corresponding to the desired quantity of particles per unit length of conductor. If there is any difference between these two signals, then the microprocessor sends a message along a feedback loop 88 or 90 to control a material dispenser 92 for the purpose of varying the amount of material dispensed through outlets 94 and 96 to adjust the quantity of particles in the mixture and correspondingly to adjust the quantity of particles per unit length of conductor towards that desired. The message sent by the microprocessor through the feedback loops is partially influenced by a signal received from a diameter scanner device 98. This device may be a laser or electron eye device for determining the diameter of the outside of the insulation on the conductor. The signal is sent from the device 98 to the microprocessor to indicate the diameter of the conductor and this signal influences the message sent from the microprocessor to the material dispenser for altering the quantities added to the mixing tank 38.

What is claimed is:

1. A method of monitoring a quantity of magnetically permeable particles in a dry dielectric carrier layer surrounding a conductor comprising passing the conductor surrounded by the layer along a feedpath and through a magnetic field created by a magnet means to cause a magnetic attraction between the particles and the magnet means, the degree of which is dependent upon the strength of the magnetic field and the quantity of particles in the layer which are affected by the field, and monitoring the degree of relative movement towards each other of the conductor and magnet means as the conductor moves along its path, while applying a resisting force against such relative movement.

2. A method according to claim 1, comprising restraining the conductor from moving towards the magnet means and monitoring the degree of movement of the magnet means towards the conductor.

3. A method according to claim 2, comprising passing the conductor along the feedpath which extends towards and away from the magnet means and through the field at a plurality of positions along the feedpath to cause a degree of movement of the magnet means dependent upon the quantity of particles affected by the field in the plurality of positions, and monitoring this degree of movement.

4. A method according to claim 3, comprising passing the conductor in a plurality of convolutions around a rotatable cylinder and creating the magnetic field with the magnet means disposed radially outwards from one sector of the cylinder.

5. A method of controlling within determined limits the quantity of magnetically permeable particles per unit length of conductor in a dry dielectric carrier layer surrounding the conductor comprising:

coating the conductor with the layer of controlled thickness and in fluid form formed as a mixture of fluid carrier material and the magnetically permeable particles;

drying the layer;

passing the conductor carrying the dried layer continuously along a feedpath and monitoring the quantity of magnetically permeable particles in the layer according to claim 1;

producing a signal corresponding to the degree of relative movement of the conductor and magnet means;

evaluating the produced signal and a datum signal and dependent upon any variation between the provided and datum signals, adjusting the input of ingredients into the mixture so as to correspondingly adjust the quantity of particles per unit length of the conductor towards that desired in the mixture.

6. A method according to claim 1, comprising orienting the particles or the magnetic domains of the particles towards a specific direction relative to the conductor before monitoring their quantity.

7. A method according to claim 5, comprising orienting the particles or the magnetic domains of the particles towards a specific direction relative to the conductor before monitoring their quantity.

* * * * *